US008229133B2

(12) United States Patent
Matsui

(10) Patent No.: US 8,229,133 B2
(45) Date of Patent: Jul. 24, 2012

(54) PORTABLE SOUND RECORDER

(75) Inventor: Naoto Matsui, Musashino (JP)

(73) Assignee: TEAC Corporation, Tokyo (JP)

( * ) Notice: Subject to any disclaimer, the term of this patent is extended or adjusted under 35 U.S.C. 154(b) by 584 days.

(21) Appl. No.: 12/351,719

(22) Filed: Jan. 9, 2009

(65) Prior Publication Data

US 2009/0185697 A1 Jul. 23, 2009

(30) Foreign Application Priority Data

Jan. 17, 2008 (JP) ..... 2008-008483

(51) Int. Cl.
*H04R 1/02* (2006.01)
*H04R 1/34* (2006.01)

(52) U.S. Cl. ..... 381/91; 381/360; 381/365

(58) Field of Classification Search ..... 381/26, 381/356, 365, 122, 355, 91, 360, 160; D14/225, D14/229; 700/94
See application file for complete search history.

(56) References Cited

U.S. PATENT DOCUMENTS

| | | | | |
|---|---|---|---|---|
| 2,763,730 | A * | 9/1956 | Paull et al. | 381/358 |
| 4,001,893 | A * | 1/1977 | Yamamoto | 360/137 |
| 6,148,089 | A * | 11/2000 | Akino | 381/356 |
| 6,307,591 | B1 * | 10/2001 | Yoshida et al. | 348/445 |
| D542,262 | S * | 5/2007 | Oka | D14/167 |
| D567,798 | S * | 4/2008 | Oka | D14/167 |
| D611,925 | S * | 3/2010 | Miyazaki | D14/167 |
| 2008/0019551 | A1 * | 1/2008 | Watanabe | 381/360 |
| 2008/0118096 | A1 * | 5/2008 | De Pooter et al. | 381/359 |
| 2008/0199034 | A1 * | 8/2008 | Zhang et al. | 381/357 |
| 2009/0129621 | A1 | 5/2009 | Izuchi et al. | |
| 2010/0008511 | A1 * | 1/2010 | Kawano | 381/26 |

FOREIGN PATENT DOCUMENTS

| | | | |
|---|---|---|---|
| JP | 62077799 | A | 4/1987 |
| JP | 03136500 | A * | 6/1991 |
| JP | 2004254074 | A * | 9/2004 |
| JP | 2007-43510 | A | 2/2007 |
| JP | 2007043510 | A * | 2/2007 |
| WO | 2006126641 | A1 | 11/2006 |

OTHER PUBLICATIONS

"Category Page Digital Voice Recorder", retrieved online Jul. 24, 2011 at http://web.archive.org/web/20071209081831/http://www.sonystyle.com/webapp/wcs/stores/serylet/CategoryDisplay?catalogId=10551&storeId=10151&langId=-1&categoryId=3703, archived on Dec. 7, 2007, 3 pages.*

(Continued)

*Primary Examiner* — Vivian Chin
*Assistant Examiner* — Andrew Graham
(74) *Attorney, Agent, or Firm* — Seed IP Law Group PLLC

(57) ABSTRACT

A portable sound recorder has a body case, a left microphone and a right microphone held rotatably by the body case. An inwardly arcuate microphone receiving cavity is formed at each upper corner of the body case. The microphone receiving cavity is configured to elevate a rear side end of its arcuate bottom surface, and surrounds the under side and a part of the rear side of the microphone. Formed on the bottom surface of the microphone receiving cavity is a hollow portion that creates a gap between the microphone receiving cavity and the microphone, so as to prevent the reflected sound off the microphone receiving cavity from reaching the microphone. The gap is maintained by the hollow portion even when the microphone is rotated.

7 Claims, 9 Drawing Sheets

OTHER PUBLICATIONS

Spence, Rick. "Sony PCM-D1 Handheld Recorder", Mix, Jul. 2006. 1 page.*
Sony ICD-MX20DR9 Digital Voice Recorder, Sony Electronics, Inc. 2007. 2 pages.*
Sony Linear PCM Recorder, Operating Instructions, PCM-D1, Sony Corporation, 2005, 52 pages.*
Sony Marketing (Japan) Inc., press release entitled 'Stereo IC recorder adapted to "Memory stick PRO Duo" capable of recording in accordance with intended purpose due to triple microphone structure will go on sale; Sony Stereo IC recorder [ICD-MX5O]' Jan. 25, 2005, 7 pages (with English-language translation).
Japanese Patent Office, Notification of Reasons for Refusal mailed Apr. 4, 2012, in corresponding JP Patent Appl. No. 2008-008483, 8 pages (with English-language translation).

* cited by examiner

PORTABLE SOUND RECORDER

FIELD OF THE INVENTION

The present invention relates to a portable sound recorder.

BACKGROUND OF THE INVENTION

Because of an easy-to-carry feature, portable sound recorders are used for a variety of sound recording purposes, such as meeting and conference recording, live music recording, wild bird call recording, and water stream sound recording. In general, the portable sound recorder is composed of a body case containing a sound recording mechanism, and one or more microphones exposed from the body case. The microphone converts sounds into electric signals, which are then recorded in a storage medium by the recording mechanism.

A type of conventional portable sound recorder, disclosed in Japanese Patent Laid-open Publication No. 2007-043510, has a pair of left and right microphones in an inverted V arrangement on top of the body case so that their axis lines intersect with each other. This inverted V arrangement enables high-quality sound recording, eliminating an effect called "hole in the middle" where sound in the center of a stereo sound filed becomes weaker than sound on both sides in stereo recording.

In this portable sound recorder, however, the microphone pair projecting in the inverted V shape from the top of the body case easily gets stuck during carriage, and impairs the portability that is an essential feature of portable sound recorders.

SUMMARY OF THE INVENTION

In view of the foregoing, a primary object of the present invention is to provide a small and easy-to-carry portable sound recorder.

Another object of the present invention is to provide a portable sound recorder enabling high-quality sound recording.

In order to achieve the above and other objects, a portable sound recorder according to the present invention includes a body case containing a recording mechanism, a microphone receiving cavity formed on the body case, a microphone placed in the microphone receiving cavity, and a hollow portion within the microphone receiving cavity. The microphone receiving cavity is recessed on the body case. The hollow portion is formed on a surface of the microphone receiving cavity, and creates a gap between the microphone receiving cavity and the microphone.

In a preferred embodiment of the present invention, the body case has a flat rectangular parallelepiped shape. The microphone receiving cavity is recessed to remove an edge between top and front surfaces of the body case.

Additionally, the microphone is held rotatably at an upper portion of the body case.

The microphone includes a microphone body held rotatably at an upper portion of the body case, a cylindrical transducer chamber formed on one side of the microphone body, a transducer disposed in the transducer chamber, and a microphone cap for covering the transducer chamber. This transducer chamber has openings on an outer peripheral surface and an end surface thereof. The transducer is arranged inclined to the outer peripheral surface and the end surface, and converts sound into an electric signal.

It is preferred to form the microphone receiving cavity on left and right sides of the body case. It is also preferred to provide the microphone on both sides of the body case.

Additionally, it is preferred to provide a handle for rotating the microphone body. More preferably, the orientation of the handle corresponds to that of the transducers. In this case, the handle preferably fixes each of the microphone caps to the microphone body.

According to the present invention, the microphones do not project from the body case, and the portable sound recorder is therefore downsized to provide excellent portability. Additionally, the gap is created behind the microphone to prevent reflected sound off the body case from degrading sound quality.

BRIEF DESCRIPTION OF THE DRAWINGS

The above objects and advantages of the present invention will become more apparent from the following detailed description when read in connection with the accompanying drawings, in which.

DETAILED DESCRIPTION OF THE PREFERRED EMBODIMENTS

Figure 1:
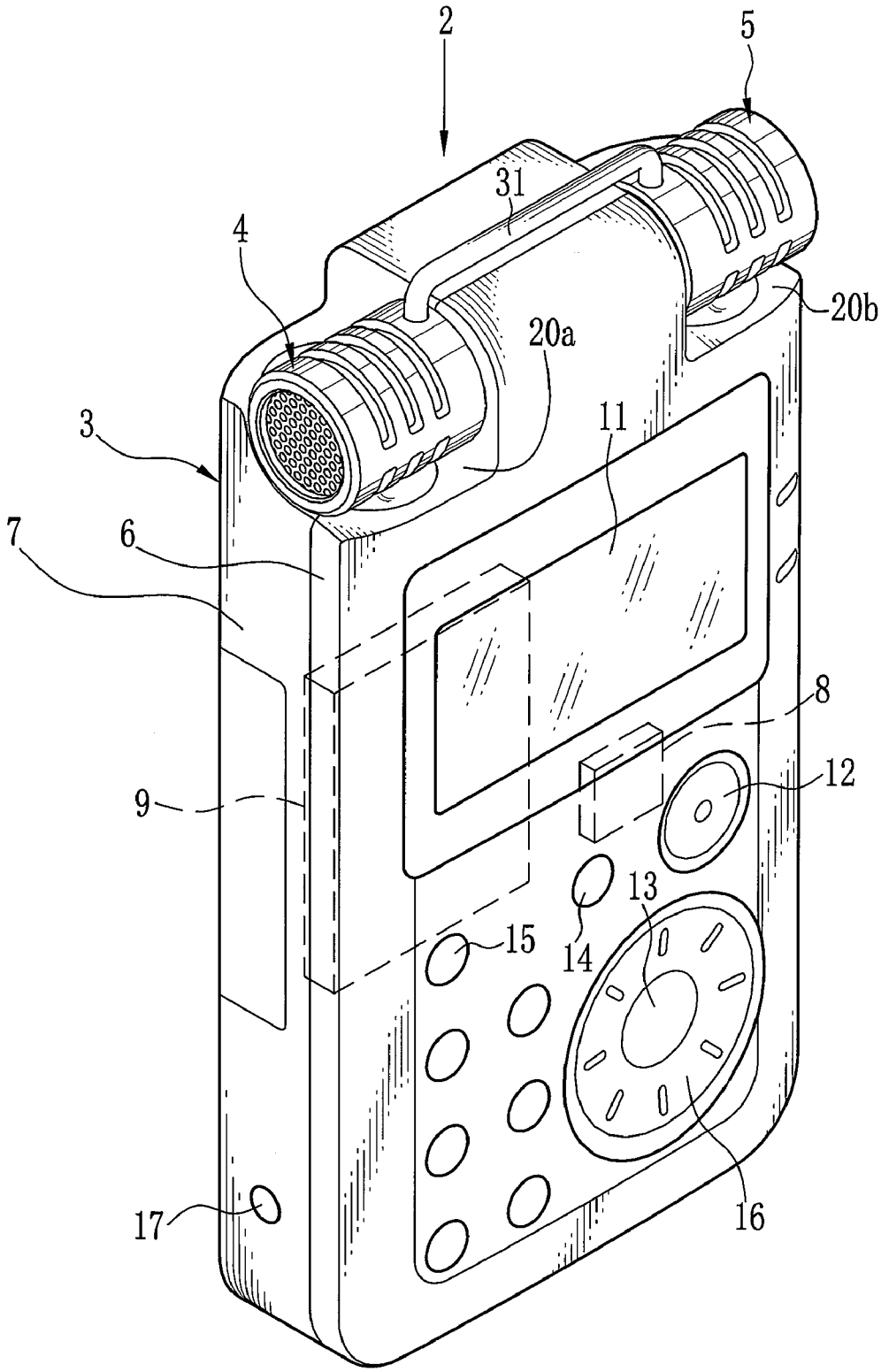
FIG. 1 is a perspective view of a portable sound recorder according to the present invention.

Referring to FIG. 1, a portable sound recorder 2 includes a body case 3 of flat rectangular parallelepiped shape, a left microphone 4 and a right microphone 5 placed at an upper portion of the body case 3. The left and right microphones 4, 5 convert surrounding sound into electric signals (audio signals).

The body case 3 includes a front cover 6 and a rear cover 7. Provided in the body case 3 is a record and playback section (hereinafter, record section) 8 to record and playback sound. The body case 3 also receives an SD card 9 detachably loaded therein. The record section 8 records the audio signals, generated by the left and right microphones 4, 5, to the SD card 9 as audio data. Additionally, the record section 8 plays back the audio data in the SD card 9.

A front surface of the body case 3 is provided with an LCD 11, a record button 12, a playback button 13, a stop button 14, a menu button 15 and a jog dial 16. An output terminal 17 appears on a side face of the body case 3. The buttons 12 to 15 are push-in buttons.

The record button 12 is pressed to start or pause recording. A press of the record button 12 brings the record section 8 to start a recording operation. One more press of the record button 12, during recording, brings the record section 8 to pause the recording operation.

The playback button 13 is pressed to start or pause a playback operation. A press of the playback button 13 brings the record section 8 to start playing back the audio data. The reproduced sound comes out from a speaker or a headphone connected to the output terminal 17. One more press of the playback button 13, during playback, brings the record section 8 to pause the playback operation.

The menu button 15 is pressed to implement or change functional setups of the portable sound recorder 2. When the menu button 15 is pressed, the LCD 11 displays a setup screen for various setups. Any desired item can be selected on the setup screen with the jog dial 16, and various setups are implemented. The LCD 11 also displays a selection screen of audio data. By operating the jog dial 16, it is possible to select the audio data to be reproduced on this selection screen.

Microphone receiving cavities 20*a*, 20*b* are formed at either upper corner of the body case 3. Each of the microphone receiving cavities 20*a*, 20*b* is recessed in an arc shape from top and front surfaces of the body case 3, while elevating a rear side end of its arcuate bottom surface, so as to correspond to the shapes of the left and right microphones 4, 5. The left and right microphones 4, 5 are located in the microphone receiving cavities 20*a*, 20*b* respectively, and surrounded on the under side and a part of the rear side by the microphone receiving cavities 20*a*, 20*b* (better shown in FIG. 6A). The left and right microphones 4, 5 completely fit into the microphone receiving cavities 20*a*, 20*b*, and do not project from the top and side surfaces of the body case 3. Therefore, the left and right microphones 4, 5 do not get stuck in a pocket or the like, and thus the portable sound recorder 2 can provide excellent portability.

Figure 2:
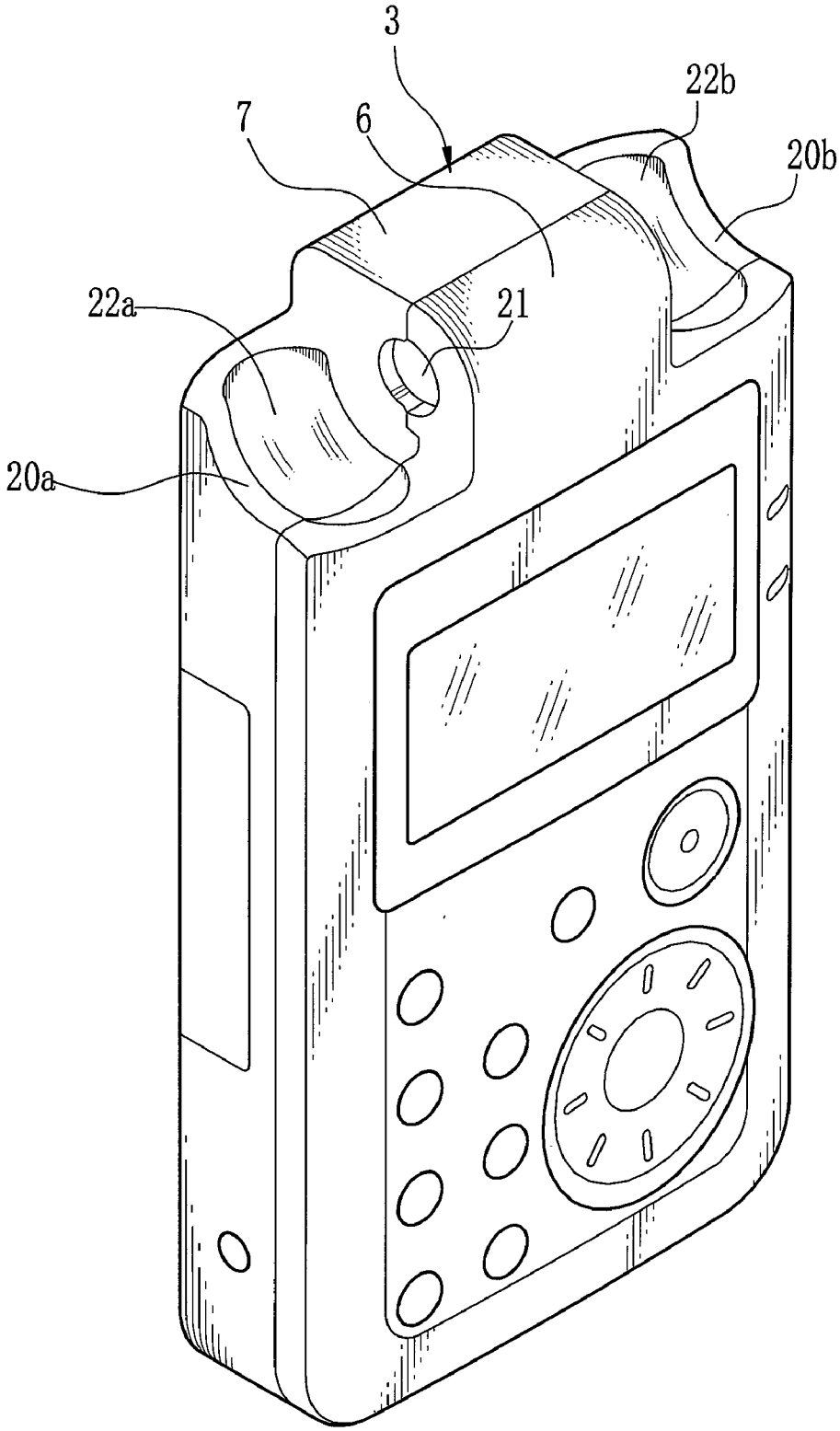
FIG. 2 is a perspective view of the portable sound recorder without a microphone unit.

As shown in FIG. 2, provided above each of the microphone receiving cavities 20*a*, 20*b* is a shaft hole 21 that opens vertically to the front surface of the body case 3. The shaft hole 21 is configured to extend across the front cover 6 and the rear cover 7, and sandwiches to hold a microphone body 25 (see FIG. 3) from front and rear sides.

The microphone receiving cavities 20*a*, 20*b* have hollow portions 22*a*, 22*b* formed on the bottom surfaces thereof. Each of the hollow portions 22*a*, 22*b* creates a gap between the microphone receiving cavity 20*a* and left microphone 4, and between the microphone receiving cavity 20*b* and the right microphone 5 respectively. Because of this gap, the sound reflected off the microphone receiving cavities 20*a*, 20*b* (hereinafter, reflected sound) is less likely to reach the left and right microphones 4, 5. Serving to eliminate undesired reflected sounds that possibly degrade sound quality, these gaps enable as high quality sound recording as if the left and right microphones 4, 5 were configured to project away from the body case 3.

Figure 3:
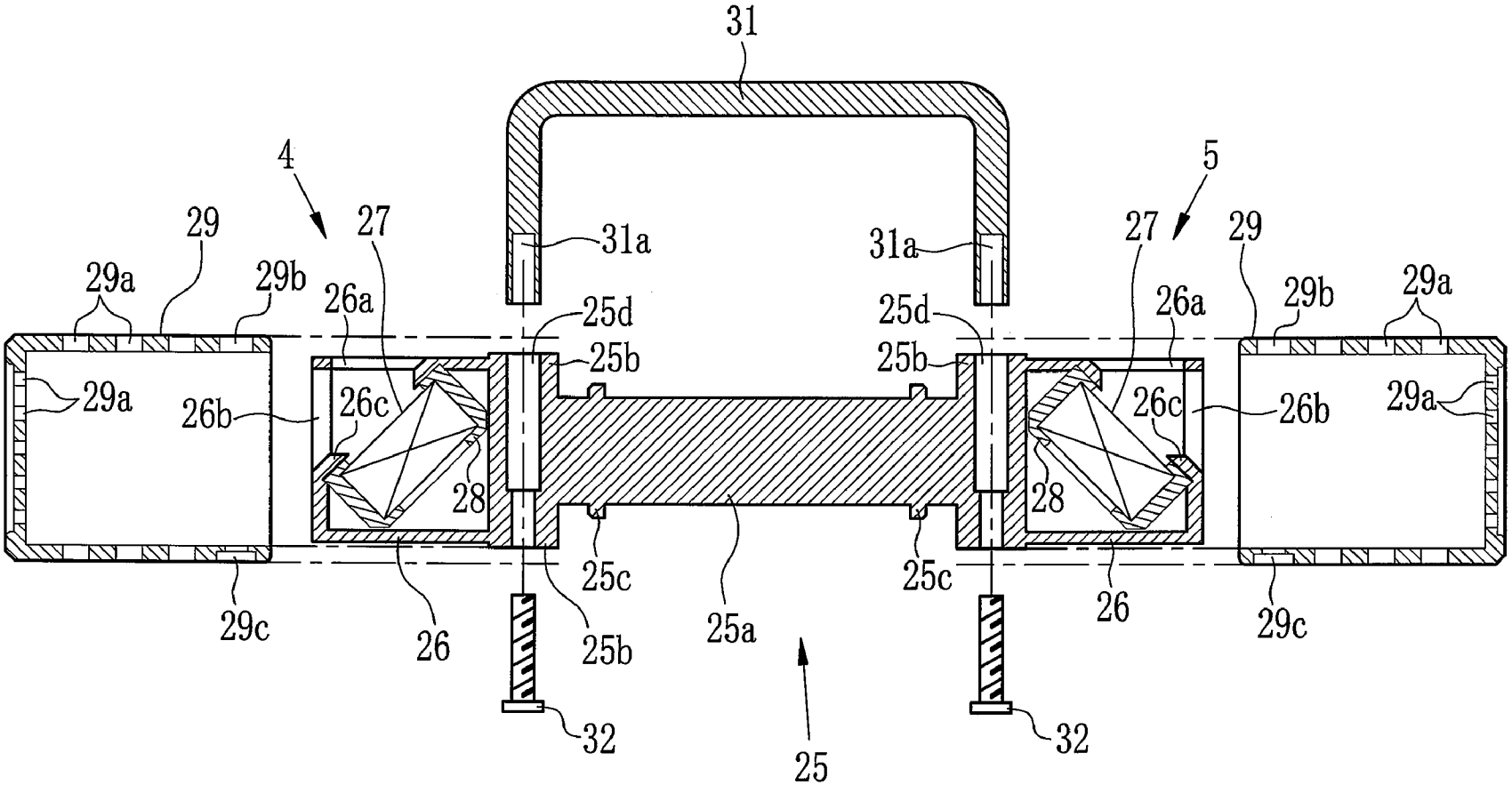
FIG. 3 is a front cross-sectional view of the microphone unit partially exploded.
Figure 4:
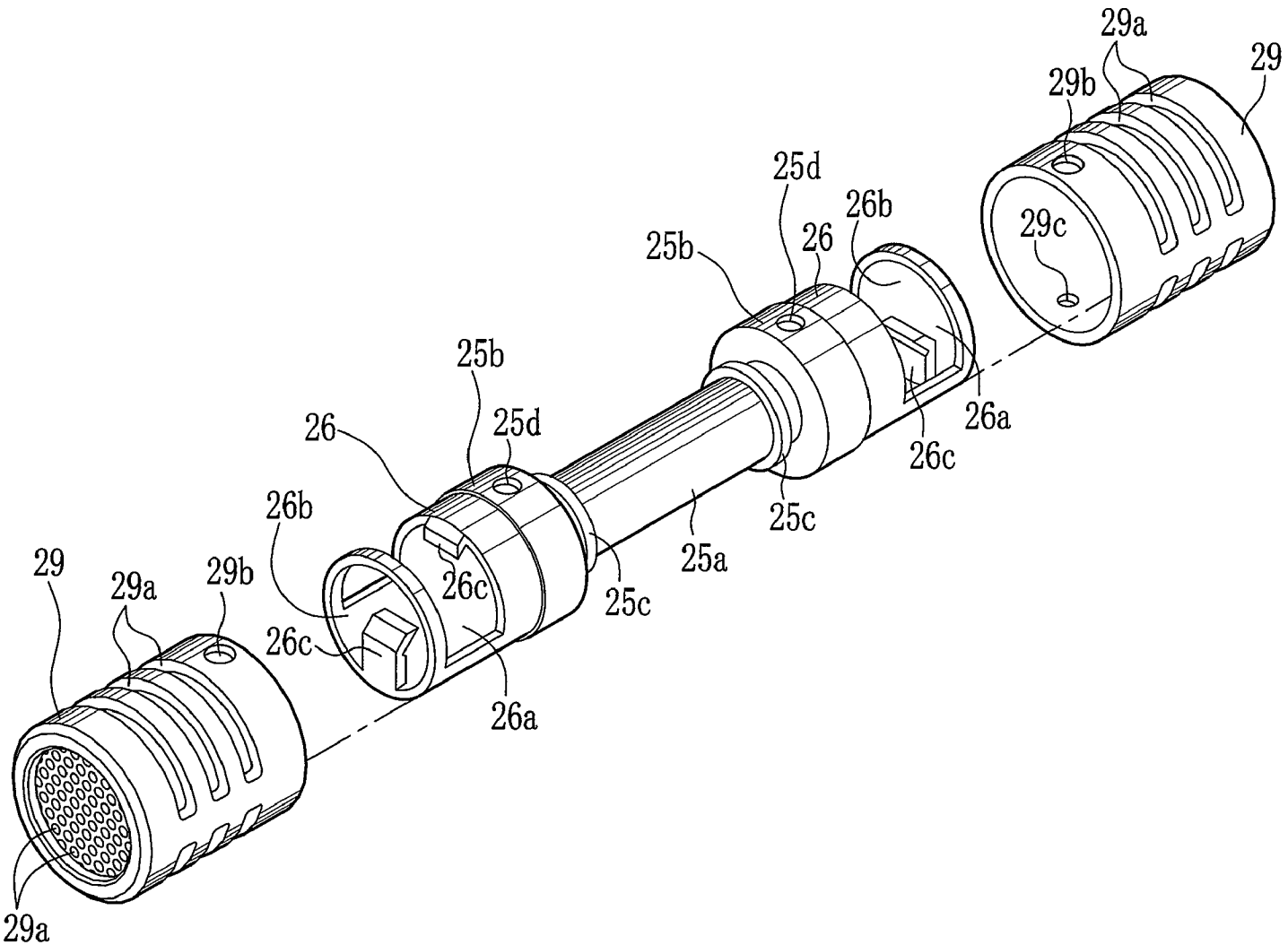
FIG. 4 is an exploded perspective view of the microphone unit.

As shown in FIG. 3 and FIG. 4, the microphone body 25 includes a shaft 25*a*, retaining portions 25*b* at both ends of the shaft 25*a*, and transducer chambers 26 extending from the retaining portions 25*b*. Positioning ribs 25*c* are formed on a peripheral surface of the shaft 25*a* in the vicinity of the retaining portions 25*b*. Each of the retaining portions 25*b* has a fitting hole 25*d* that pierces the retaining portion 25*b* and receives a handle 31. Although not shown, the shaft 25*a* has an axially extending horizontal through hole, into which signal wires of the microphones 4, 5 are inserted. This through hole is connected at the middle thereof to a vertical hole which vertically pierces the shaft 25*a*. Through this vertical hole, the signal wires go into the body case 3.

Each transducer chamber 26 is substantially cylindrical, and encases a transducer 27 for converting sound into sound signals. The transducer 27 has a disk-like shape, and wears an annular rubber-made protective cover 28.

Formed on an outer peripheral surface of the transducer chamber 26 is a sound entry opening 26*a* through which sound waves reach the left and right microphones 4, 5. The sound entry opening 26*a* has a belt-like shape extending radially over a 220° angular range about a central axis of the transducer chamber 26. Additionally, a circular sound entry opening 26*b* is formed on a front end face of the transducer chamber 26. Inside the transducer chamber 26, a pair of attachment ribs 26*c* is provided. The transducer 27 is attached to the attachment ribs 26*c* and inclined at, for example, 45° to the sound entry openings 26*a*, 26*b*.

Each transducer chamber 26 is covered with a microphone cap 29. On a peripheral surface and a front end face of the microphone cap 29, a plurality of sound entry ports 29*a* are formed to correspond to the sound entry openings 26*a*, 26*b*. The microphone cap 29 also has a handle insert hole 29*b* and a screw insert hole 29*c* at the positions corresponding to the fitting hole 25*d*.

The fitting hole 25*d* is a stepped hole having two large and small inner diameters. The handle 31 is inserted through the handle insert hole 29*b* into a large diameter portion of the fitting hole 25*d*. The handle 31 has a channel shape, and is operated to turn the microphone body 25 and the transducer 27 together. The large diameter portion of the fitting hole 25*d*, which receives the handle 31, opens to the same direction as the sound entry opening 26*a*. When inserted into this large diameter portion, the handle 31 faces the same direction as the sound entry opening 26*a* or, namely, a forward direction of the transducer 27. It is therefore possible to aim the transducer 27 at a sound source by turning the handle 31 to the sound source.

Figure 5:
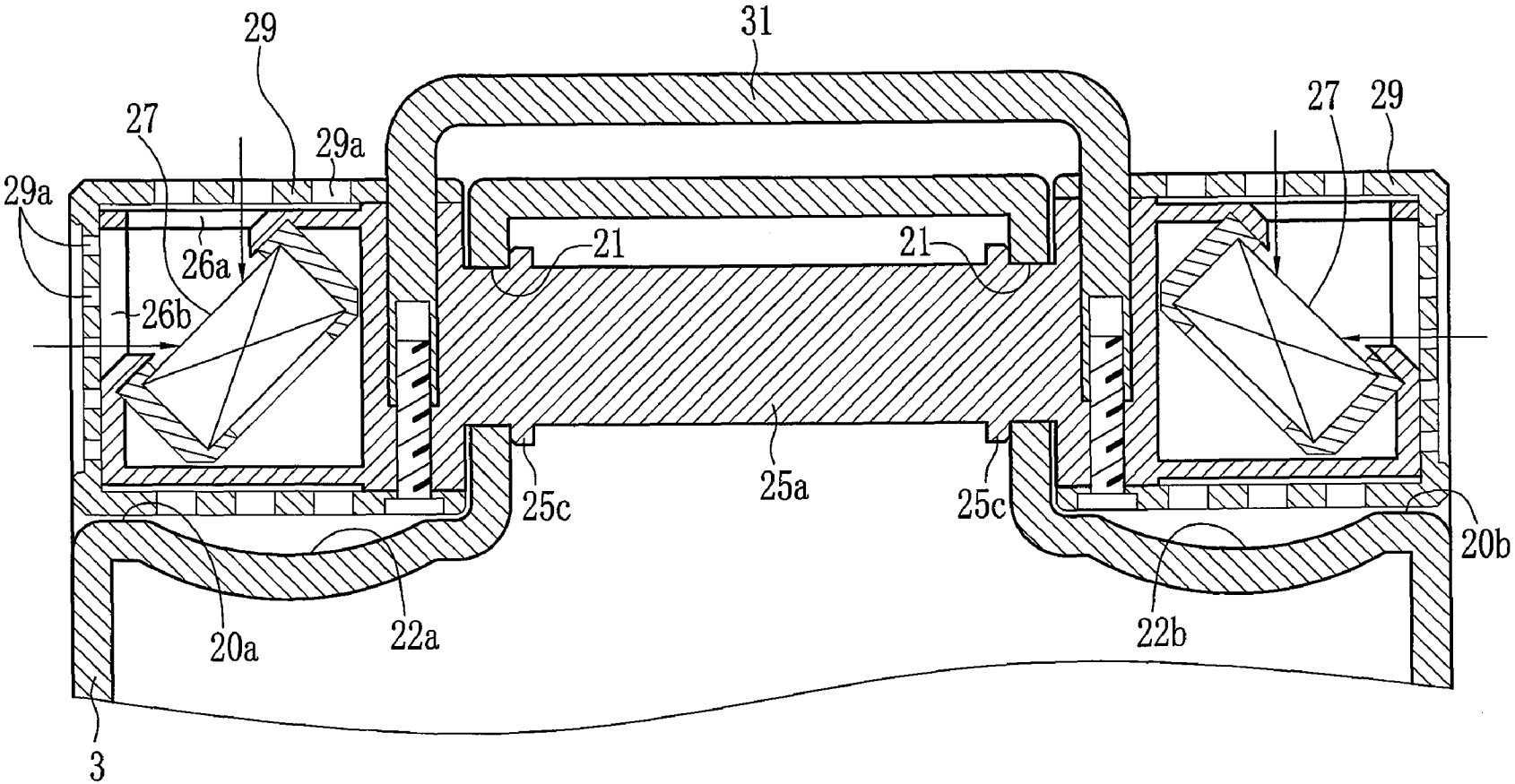
FIG. 5 is a front cross-sectional view of an upper portion of a body case and the microphone unit.

A screw 32 is inserted through the screw insert hole 29*c* into a small diameter portion of the fitting hole 25*d*. The screw 32 is twisted to engage with a screw threaded hole 31*a* on a tip of the handle 31. The left and right microphones 4, 5 are thereby assembled into a microphone unit shown in FIG. 5.

The front cover 6 and the rear cover 7 of the body case 3 are joined together such that they sandwich this united left and right microphones 4, 5 from front and rear. In this state, the shaft 25*a* fits into the shaft holes 21, and the positioning ribs 25*c* contact the interior surface of the body case 3. The left and right microphones 4, 5 are now horizontally positioned and rotatably held by the body case 3.

Next, the operation of the portable sound recorder 2 is explained hereafter. To make recording with the portable sound recorder 2, the handle 31 is first turned to a sound source. This turning action of the handle 31 rotates the microphone body 25, and sets the transducers 27 to incline at 45° to the sound source.

Figure 6A:
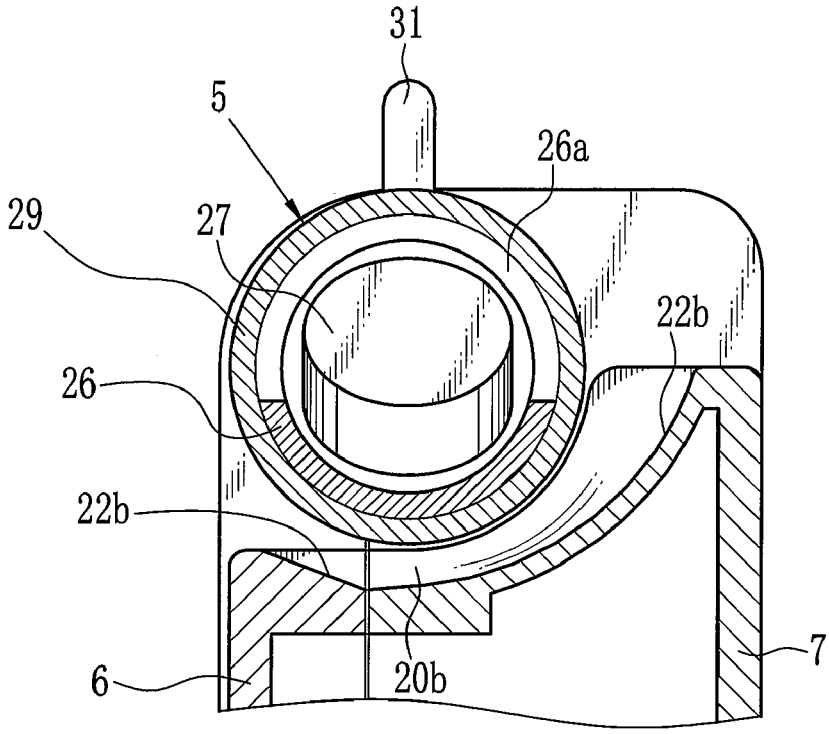
FIG. 6A is a right cross-sectional view of the upper portion of the portable sound recorder with a handle facing upward.
Figure 6B:
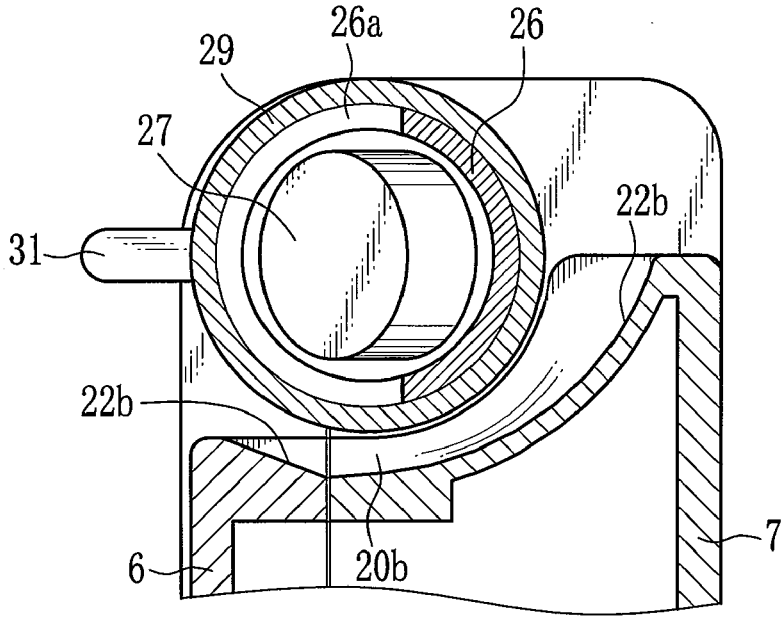
FIG. 6B is a right cross-sectional view of the upper portion of the portable sound recorder with the handle facing forward.

As shown in FIG. 6A, the handle 31 is turned to an upward direction of the body case 3 when a sound source exists above the portable sound recorder 2. In this case, the transducers 27 of both the left and right microphones 4, 5 face upward. Alternatively, as shown in FIG. 6B, the handle 31 is turned to a forward direction of the body case 3 when a sound source exists in front (the front cover 6 side) of the portable sound recorder 2. With the left and right microphones 4, 5 aiming at the sound source, the record button 12 is pressed. In response, the transducers 27 start converting the sound around the left and right microphones 4, 5 into audio signals. The record section 8 stores the audio signals as audio data to the SD card 9. A thing to note in this embodiment is that the left and right microphones 4, 5 are configured to rotate within 90° angular range from the upward facing position to the forward facing position, and can be adjusted at any angle within this angular range.

At any angle of the microphones 4, 5, the hollow portions 22*a*, 22*b* create the gaps behind the microphones 4, 5. Therefore, sound quality is hardly degraded by the reflect sound from the microphone receiving cavities 20*a*, 20*b*.

The left and right microphones 4, 5 are more surrounded when facing upward, as shown in FIG. 6A, than when facing forward, as shown in FIG. 6B, by the microphone receiving cavities 20*a*, 20*b*. In other words, the reflected sound from the microphone receiving cavities 20*a*, 20*b* is more likely to concern when the left and right microphones 4, 5 face upward. In view of this, experiments are conducted with the left and right microphones 4, 5 facing upward so as to evaluate the effect of the hollow portions 22*a*, 22*b*.

Figure 7:
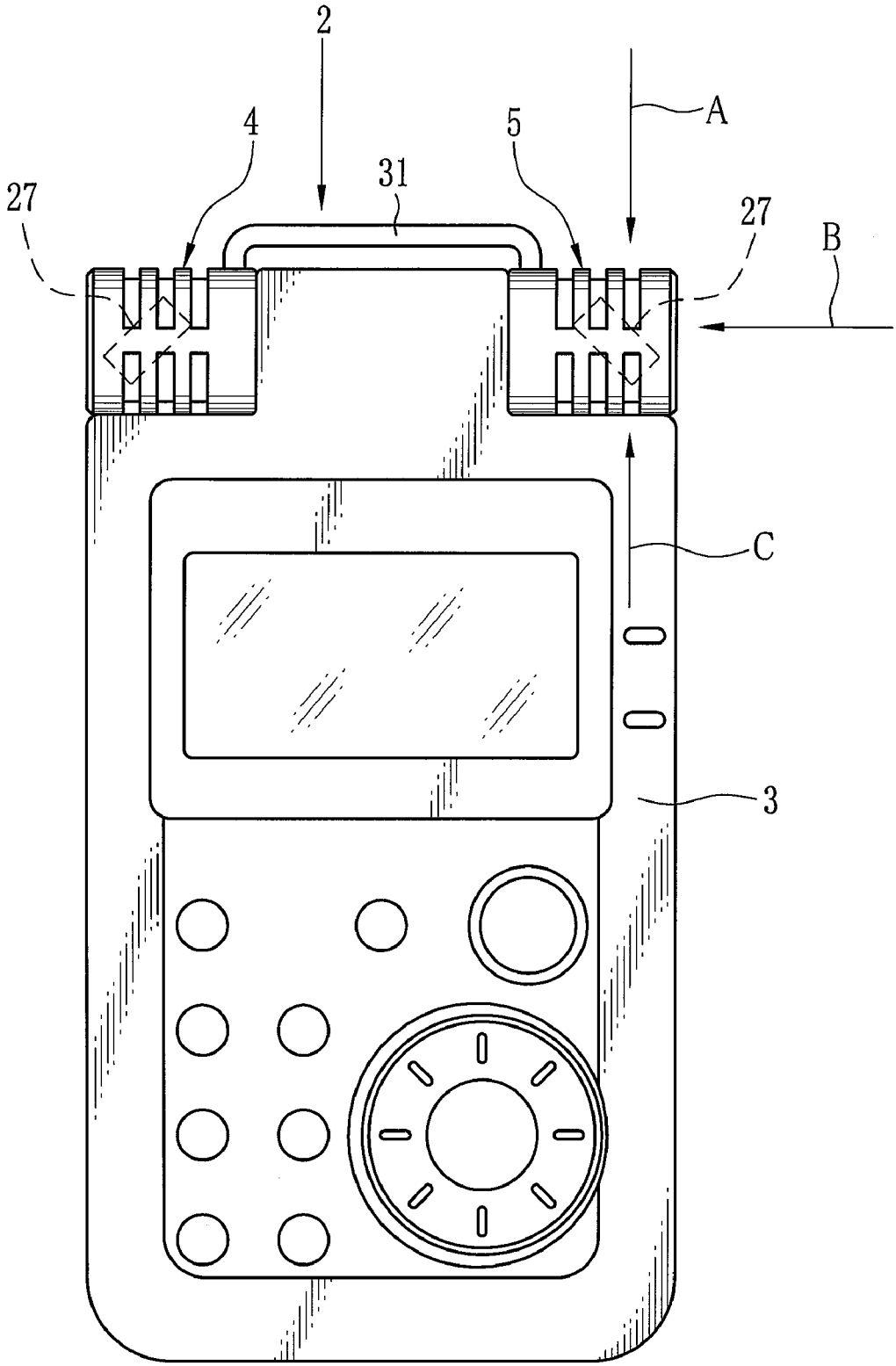
FIG. 7 is a front elevation view of the portable sound recorder with the handle facing upward.

As shown in FIG. 7, the handle 31 was turned to the upward direction of the body case 3 (i.e., the left and right microphones 4, 5 faced upward), and test tone sweeping between 60 Hz and 200 kHz was fed to the right microphone 5 from above (A direction), side (B direction) and below (C direction). The test tone was recorded with the right microphone 5, and frequency response characteristics were measured. This measurement was performed with the hollow portion 22*b* (the present invention) and without the hollow portion 22*b*.

Figure 8:
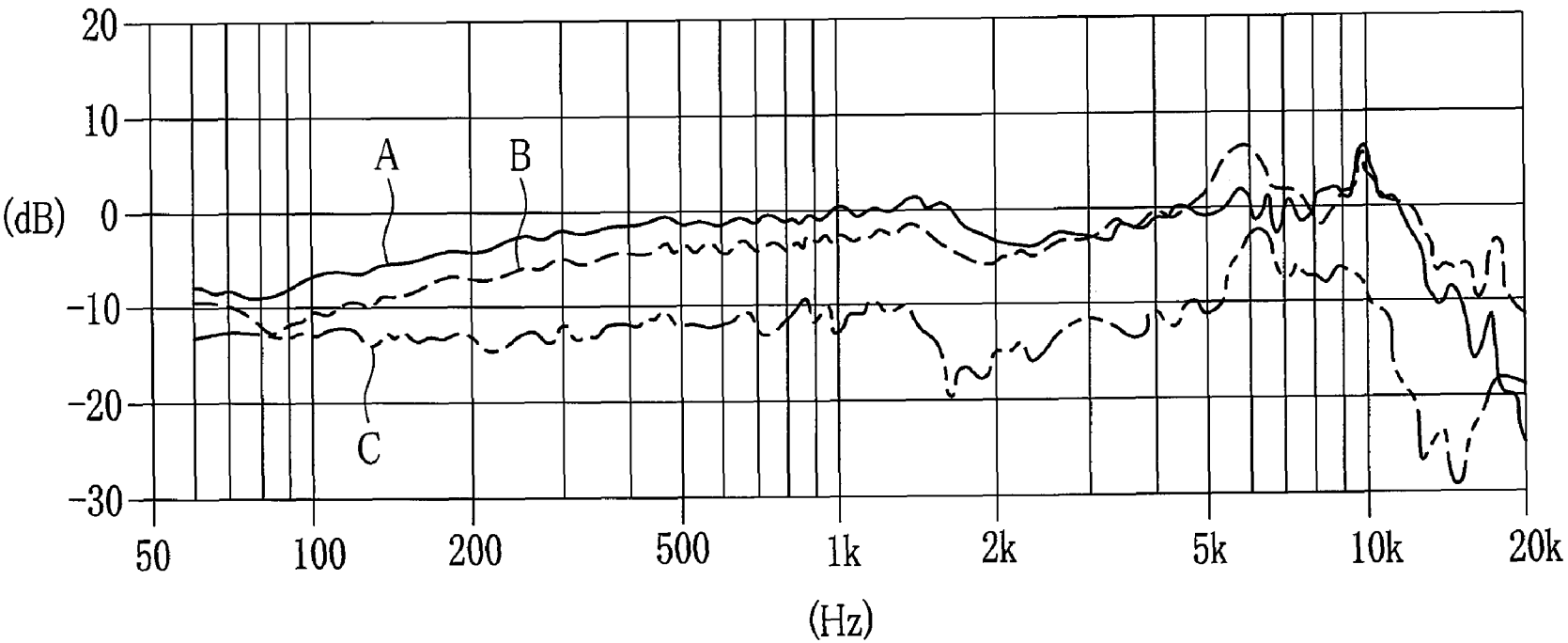
FIG. 8 is a graph showing the frequency response of a microphone combined with a hollow portion.

A graph of FIG. 8 shows frequency response curves for the test tones in the A, B and C directions (hereinafter, A direction frequency response curve, B direction frequency response curve and C direction frequency response curve) of the right microphone 5 with the hollow portion 22*b*. On the other hand, a graph of FIG. 9 shows the A, B and C direction frequency response curves of the right microphone 5 without the hollow portion 22*b*.

Figure 9:
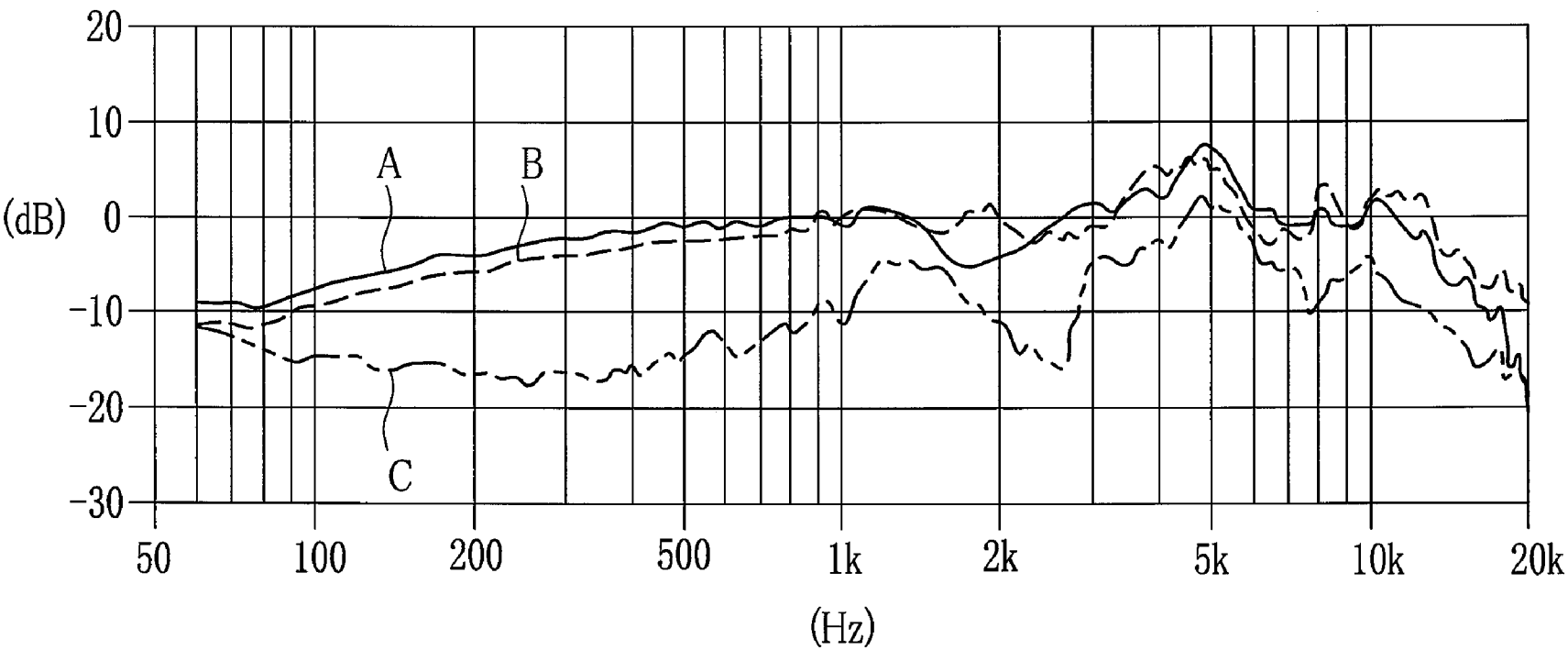
FIG. 9 is a graph showing the frequency response of the microphone without the hollow portion.

As is obvious from FIG. 8 and FIG. 9, without the hollow portion 22*b*, the right microphone 5 was influenced by reflected sound from the microphone receiving cavity 20*b*, and the A and B direction frequency response curves have different waveforms in a high-frequency region between 1 kHz and 10 kHz (especially between 1.5 kHz and 3.5 kHz). In this case, sound arriving from the sensitive directions of the microphone (sound arriving from the A and B directions) cannot be recorded at high quality.

With the hollow portion 22*b*, to the contrary, the right microphone 5 was not influenced by the reflected sound from the microphone receiving cavity 20*b*, and the A and B direction frequency response curves have similar waveforms at between 1 kHz and 10 kHz. Therefore, the sound arriving from the sensitive directions of the microphone can be recorded at high quality.

To make matters worse, without the hollow portion 22*b*, the C direction frequency response curve (frequency response curve for the sound arriving from the opposite direction to the sensitive direction) partly came close to the A and B direction frequency response curves (frequency response curves for the sounds arriving from the sensitive directions) at between 1 kHz and 10 kHz. This prevents recording the sound from the opposite direction to the sensitive direction at high quality, and narrows the directivity of the right microphone 5.

With the hollow portion 22*b*, to the contrary, the C direction frequency response curve was improved to stay away from the A and B direction frequency response curves at between 1 kHz and 10 kHz because there was no reflected sound from the microphone receiving cavity 20*b* to influence. The sound from the opposite direction to the sensitive direction was therefore recorded at high quality. This served to enlarge the directivity of the right microphone 5, and provide excellent stereophonic effect. The same was applied to the left microphone 4.

In the above embodiment, the transducer 27 is arranged diagonally in the transducer chamber 26. However, the transducer 27 may be arranged horizontally in the transducer chamber 26.

While the portable sound recorder 2 has two microphones 4, 5 at both ends of the body case 3, the present invention is applicable to a portable sound recorder having a single microphone at either side of the body case.

Although the hollow portions 22*a*, 22*b* are formed on the bottom surface of the microphone receiving cavities 20*a*, 20*b*, the position of the hollow cavity is not particularly limited. For example, in the case that the left and right microphones 4, 5 are fixed to the bottom surfaces of the microphone receiving cavities, the hollow portion may be formed on a side surface of each microphone receiving cavity.

Although the present invention has been fully described by the way of the preferred embodiments thereof with reference to the accompanying drawings, various changes and modifications will be apparent to those having skill in this field. Therefore, unless otherwise these changes and modifications depart from the scope of the present invention, they should be construed as included therein.

What is claimed is:

1. A portable sound recorder having a body case containing a recording mechanism, comprising:

at least one microphone receiving section that forms a cavity on the body case; and a microphone body comprising at least one microphone and at least one coupling member that couples the at least one microphone to the body case, wherein the at least one microphone is placed in the cavity of the at least one microphone receiving section, wherein an external configuration of the at least one microphone corresponds to a recessed contour of the at least one microphone receiving section such that the at least one microphone is proximate a surface of the at least one microphone receiving section, wherein the recessed contour is surrounded by the surface of the at least one microphone receiving section, such that the recessed contour of the at least one microphone receiving section creates a reflected sound wave reduction gap between the recessed contour of the at least one microphone receiving section and the at least one microphone.

2. The portable sound recorder of claim 1, wherein said body case has a flat rectangular parallelepiped shape, and said microphone receiving section removes an edge between top and front surfaces of said body case.

3. The portable sound recorder of claim 2, wherein said at least one microphone is held rotatably at an upper portion of said body case.

4. The portable sound recorder of claim 2, wherein said at least one microphone comprises:

a cylindrical transducer chamber formed on one side of said microphone body, said transducer chamber having openings on an outer peripheral surface and an end surface thereof;

a transducer in said transducer chamber and arranged inclined to said outer peripheral surface and said end surface, so as to convert sound into an electric signal; and a microphone cap for covering said transducer chamber, wherein said microphone body is held rotatably at an upper portion of said body case.

5. The portable sound recorder of claim 4, wherein microphone receiving sections are formed on left and right sides of said body case, and microphones are provided on both sides of said body case.

6. The portable sound recorder of claim 5 further comprising:

a handle for rotating said microphone body and oriented to correspond to the orientation of said transducers.

7. The portable sound recorder of claim 6, wherein said handle fixes each said microphone cap to said microphone body.

* * * * *

UNITED STATES PATENT AND TRADEMARK OFFICE

CERTIFICATE OF CORRECTION

PATENT NO. : 8,229,133 B2
APPLICATION NO. : 12/351719
DATED : July 24, 2012
INVENTOR(S) : Naoto Matsui It is certified that error appears in the above-identified patent and that said Letters Patent is hereby corrected as shown below:

Title Page

Item (56):
""Category Page Digital Voice Recorder", retrieved online Jul. 24, 2011 at http://web.archive.org/web/20071209081831/http://www.sonystyle.com/webapp/wcs/stores/serylet/CategoryDisplay?catalogId=10551&storeId=10151&langId=-1&categoryId=3703, archived on Dec. 7, 2007, 3 pages."

should read,

--"Category Page Digital Voice Recorder", retrieved online Jul. 24, 2011 at http://web.archive.org/web/20071209081831/http://www.sonystyle.com/webapp/wcs/stores/servlet/CategoryDisplay?catalogId=10551&storeId=10151&langId=-1&categoryId=3703, archived on Dec. 7, 2007, 3 pages.--.

Signed and Sealed this
Fourth Day of September, 2012

David J. Kappos

David J. Kappos
*Director of the United States Patent and Trademark Office*